US007963712B2

(12) United States Patent
Sogaro

(10) Patent No.: US 7,963,712 B2
(45) Date of Patent: Jun. 21, 2011

(54) DISPOSABLE DISPENSING DEVICE

(75) Inventor: Alberto C. Sogaro, Kronberg (DE)

(73) Assignee: Sulzer Mixpac AG, Haad (CH)

( * ) Notice: Subject to any disclaimer, the term of this patent is extended or adjusted under 35 U.S.C. 154(b) by 919 days.

(21) Appl. No.: 11/417,799

(22) Filed: May 4, 2006

(65) Prior Publication Data

US 2006/0257199 A1 Nov. 16, 2006

(30) Foreign Application Priority Data

May 10, 2005 (EP) ..... 05010168

(51) Int. Cl.
*B43K 5/14* (2006.01)

(52) U.S. Cl. ..... 401/133; 401/132; 401/268

(58) Field of Classification Search ..... 401/183, 401/186, 132–135; 222/540–541.4, 541.6, 222/541.9, 107, 212, 96, 94, 215; 604/3, 604/200

See application file for complete search history.

(56) References Cited

U.S. PATENT DOCUMENTS

| | | | | |
|---|---|---|---|---|
| 3,847,151 | A * | 11/1974 | D'Alessandro et al. | 604/3 |
| 3,908,654 | A * | 9/1975 | Lhoest et al. | 604/200 |
| 3,993,223 | A * | 11/1976 | Welker et al. | 222/107 |
| 4,467,588 | A * | 8/1984 | Carveth | 53/425 |
| 4,792,060 | A * | 12/1988 | Brogli | 222/107 |
| 4,990,016 | A * | 2/1991 | Seidler | 401/132 |
| 5,409,125 | A * | 4/1995 | Kimber et al. | 222/107 |
| 5,632,416 | A * | 5/1997 | Lane et al. | 222/105 |
| 5,678,736 | A * | 10/1997 | Hansen | 222/209 |
| 5,918,783 | A * | 7/1999 | Kieras et al. | 222/541.6 |
| 6,241,132 | B1 * | 6/2001 | Morrison | 222/541.6 |
| 6,460,781 | B1 * | 10/2002 | Garcia et al. | 239/327 |
| 6,585,134 | B2 * | 7/2003 | Farris | 222/541.6 |
| 6,619,516 | B2 * | 9/2003 | Weiler et al. | 222/541.9 |
| 6,626,308 | B2 * | 9/2003 | Weiler | 222/541.6 |
| 6,805,263 | B2 * | 10/2004 | Garcia et al. | 222/541.6 |
| 6,874,665 | B2 * | 4/2005 | Doherty et al. | 222/541.5 |
| 7,100,802 | B2 * | 9/2006 | Sogaro | 401/133 |
| 7,185,790 | B2 * | 3/2007 | Weiler | 222/541.6 |
| 7,416,358 | B2 * | 8/2008 | Legendre | 401/133 |
| 7,431,529 | B1 * | 10/2008 | Rushe et al. | 401/133 |
| 2004/0253039 | A1 * | 12/2004 | Stenton | 401/132 |

FOREIGN PATENT DOCUMENTS

| | | | |
|---|---|---|---|
| DE | 3122237 | A1 | 5/1983 |
| DE | 100 09 629 | A1 | 9/2001 |
| EP | 0299562 | A1 | 1/1989 |
| GB | 1297302 | * | 2/1970 |
| GB | 1297302 | | 11/1972 |

OTHER PUBLICATIONS

Abstract of German Patent DE 100 09 629 A1.

* cited by examiner

*Primary Examiner* — Gregory L Huson
*Assistant Examiner* — Keegan Gumbs
(74) *Attorney, Agent, or Firm* — Quarles & Brady LLP

(57) ABSTRACT

A disposable dispensing device for liquid, paste and other flowable or free-flowing materials, includes a fillable and sealable plastic enclosure (12) with an absorption section (16) having a storage compartment (18) and a sealing section (20). The sealing section (20) may be separated from the absorption section (16) by a tear seam (22). A fitted applicator (14) and a channel (40) assist with dispensing the material from the plastic enclosure (12). A sealing device (38), which closes the channel (40), is molded to the applicator (14) by a separating section (42) forming part of the sealing section (20) of the plastic enclosure (12). In order to dispense the material through the channel (40) of the applicator (14), the sealing device (38) can be detached from the applicator (14) at the separating section (42).

24 Claims, 3 Drawing Sheets

DISPOSABLE DISPENSING DEVICE

CROSS REFERENCES TO RELATED APPLICATIONS

This application claims the priority benefit of European Patent Application No. 05010168.2 filed on May 10, 2005.

STATEMENT REGARDING FEDERALLY SPONSORED RESEARCH

Not Applicable.

BACKGROUND OF THE INVENTION

The invention relates to a disposable dispensing device for liquid, paste, flowable or free-flowing materials.

Disposable dispensing devices for the above-mentioned materials, which may also include gels, powdery material and material mixtures, are especially useful in the cosmetic and medical sectors. Such disposable dispensing devices should be capable of being manufactured as cost-effectively as possible on the one hand, and on the other hand be reliable and easy to use. They should also be rugged and leakproof enough to weather storage and transport without damage.

A disposable container is known from each of the patents U.S. Pat. No. 4,982,828 or DE 100 09 629 A1, which comprises an applicator and a storage compartment for flowable material, as well as, discharging compartments that can be opened with a perforation or peeling device and in which the applicator is configured. Unfortunately, the peeling, pulling-off process, or the ripping open of the perforation can cause undesirable splashing of the material.

SUMMARY OF THE INVENTION

The object of the present invention is to create a disposable dispensing device of the aforementioned kind for the targeted extraction of the material without spontaneous and undesirable splashing upon opening. This object is accomplished with a disposable dispensing device incorporating the present invention.

One embodiment of present invention provides a disposable dispensing device for liquid, paste and other flowable or free-flowing materials. The disposable dispensing device comprises a fillable and sealable plastic enclosure which has an absorption section in the compartment for storing the material, which for instance has a neck on the one end and a filling end facing the opposite direction of the filling end, as well as, lateral sealing seams, and a sealing section, which is separated from the absorption section by means of a tear seam and/or perforation seam, as well as an applicator which is housed in the plastic enclosure and which has a channel for discharging the material from the plastic enclosure. In addition, a closing device for the channel of the applicator can be provided, which, for example may be molded to the applicator by means of a predetermined breaking point that represents the separation area and which can be detached from the applicator by means of the separation area in order to extract the material.

The disposable dispensing device thus comprises a separate sealed applicator made of plastic that is specifically shaped, which ensures excellent sealing characteristics by means of a preferably monobloc molding of the sealing device to the applicator. In this way, for example, no material can penetrate from the storage compartment into any existing cavities of the sealing section of the plastic enclosure and escape from there inadvertently when opening the disposable dispensing device.

Such a disposable dispensing device is particularly suited for medical and/or cosmetics applications, such as the application of nose drops, eye drops, or iodine solution, tissue and/or wound adhesive, wart treatment tincture and/or similar applications.

The term "tear seam" is understood in the widest sense to represent a defined line along which the plastic enclosure can preferably be ripped open. The tear seam can be formed by a reduction in the material strength, permitting perforation, or similar.

In a special embodiment of the disposable dispensing device according to the invention, the separation area opposite the tear seam and/or line has been offset in the direction facing away from the storage compartment.

This configuration of the separation area which, for example, can be formed by a reduction in the material strength between the applicator and the sealing device for the applicators, as well as, the tear seam between the storage compartment and the sealing section of the plastic enclosure, is an efficient method to prevent undesirable, spontaneous splashing of material when the disposable dispensing device is opened, i.e. when separating the sealing section from the absorption section and the sealing device from the applicator. When opening the disposable dispensing device according to the invention, the sealing device for the applicator is simultaneously detached with the sealing section of the plastic enclosure. In the event that a drop leaks from the applicator during opening, it will be absorbed by the sealing section of the plastic enclosure due to the offset arrangement of the separation area and the tear seam. This drop thus remains in the disposable dispensing device. This is particularly desirable in cosmetic and/or medical applications.

In a preferred embodiment of the disposable dispensing device according to the invention, the sealing device for the applicator comprises an activating tab, which preferably represents a tapered or peg-shaped end of the sealing device. If this end of the sealing device for the applicator is shaped in the form of a tapered paddle-like tip, this achieves good embedment of the sealing device in the sealing section of the plastic enclosure. This type of design provides a large working surface for the sealing section of the plastic enclosure, which essentially presents a further advantage for the simultaneous detachment of the sealing device for the applicator and the sealing section of the plastic enclosure.

It is particularly easy to detach the sealing device for the applicator if the activating device of the sealing device is interlocked with the sealing section. Unfastening the sealing section which is preferably designed with a certain rigidity from the storage compartment of the plastic enclosure thus directly causes the detachment and/or unfastening of the sealing device from the applicator.

To produce the disposable dispensing device essentially requires two components to be connected to each other: Initially, the applicator that has been provided with the sealing device must be inserted into the plastic enclosure. Then the plastic enclosure must be sealed, so that the applicator fits securely inside the plastic enclosure. In addition, the tear seam and/or tear line between the sealing section and the storage compartment of the plastic enclosure must still be configured, which, however, can be done quickly, precisely and reliably using regular tools.

The plastic enclosure is preferably formed from two films that are sealed together. In the present case, "sealing" means any suitable method for joining the areas of the disposable dispensing device made of plastic or of other materials. For example, for sealing, a heat sealing process, a cold sealing process, a welding process, such as ultrasonic welding or another cold forming process, can be used that is suitable for joining together plastic films of similar materials.

The plastic enclosure of the disposable dispensing device according to the invention is preferably made of a thermoplastic polymer, which is preferably manufactured from plastic film by a method used for the standard packaging of suppositories, which, after sealing around the edges, is shaped into enclosures by means of vacuum forming or alternatively by using highly pressured gas. In this manner, it is possible to manufacture a particularly cost-efficient disposable dispensing device, which can be easily provided with sealing seams as well as the tear seam.

The plastic enclosure can also be manufactured from two films in the form of an ampoule that is open on the top and on the bottom, which, after assembly with the desired applicator, to which the sealing device is molded, can be provided with the tear seam and additional sealing seams. A plastic enclosure manufactured using this method is generally convex on both sides, which has the advantage that the plastic enclosure can be elastically deformed by compression if suitable materials and wall thicknesses are selected for the plastic enclosure, in order to activate the disposable dispensing device. In this manner, after tearing off the sealing section from the storage compartment of the plastic enclosure along the tear seam and the subsequent tearing-off of the sealing device from the applicator, a user can deliberately load the material which is in the storage compartment into the applicator, by single or multiple compression of the plastic enclosure, resulting in that this material is dispensed from the disposable dispensing device.

The applicator preferably has a pencil-shaped design, so that during the manufacture of the disposable dispensing device, it can be easily inserted into the plastic enclosure through an upper or lower opening that is subsequently closed.

The applicator can comprise a neck end of increased or decreased diameter that fits into the neck section facing away from the filling end of the plastic enclosure and preferably comprises a groove into which the plastic enclosure engages, ensuring that the applicator fits securely into the plastic enclosure.

In addition, the applicator can comprise a ring collar that is supported on the plastic enclosure for axial positioning, ensuring the defined axial positioning of the applicator.

In the simplest case, the applicator is a discharge device configured in the form of a pipe section, which is fitted into the neck end of the plastic enclosure. However, multiple forms of the applicator are conceivable. Thus, the applicator may, for example, comprise a diffuser, a brush, an outlet nozzle with an internal taper and/or similar objects.

In another special embodiment of the disposable dispensing device according to the invention, the applicator is provided with an application section, which is connected to a securing section of the applicator. Such an application section, which, for example, may come into contact with the skin of the respective person during application, may be a separate component or it may also be manufactured as an integral part of the applicator.

The application section may comprise a brush unit or a plastic foam unit. Specifically in this case, the channel of the applicator terminates preferably in the area, i.e. at the level of the brush unit and/or the plastic foam unit, so that the separation area between the sealing device and the applicator is included in the brush and/or plastic foam unit. The brush and/or the plastic foam unit in this case also serves as a splash guard when the disposable dispensing device is opened.

The disposable dispensing device according to the invention can also be so configured that the storage compartment can house a first material component and the applicator can house a second material component. In particular, the second material component, which can be a powder, a paste, or a liquid, may be absorbed, for example, by a brush hair or plastic foam unit inserted in the application section of the applicator. When the disposable dispensing device is opened and during the subsequent discharge of the first material component from the storage compartment, it is then mixed with the second material component. The mixing ratios can be determined by appropriate design of the storage compartment and the application section.

Further advantages and advantageous embodiments of the subject matter of the invention can be found in the specifications, in the drawing and in the claims.

BRIEF DESCRIPTION OF THE DRAWINGS

The drawing shows a simplified schematic of three embodiments of the disposable dispensing device according to the invention, as follows.

DESCRIPTION OF THE PREFERRED EMBODIMENT

Figure 1:
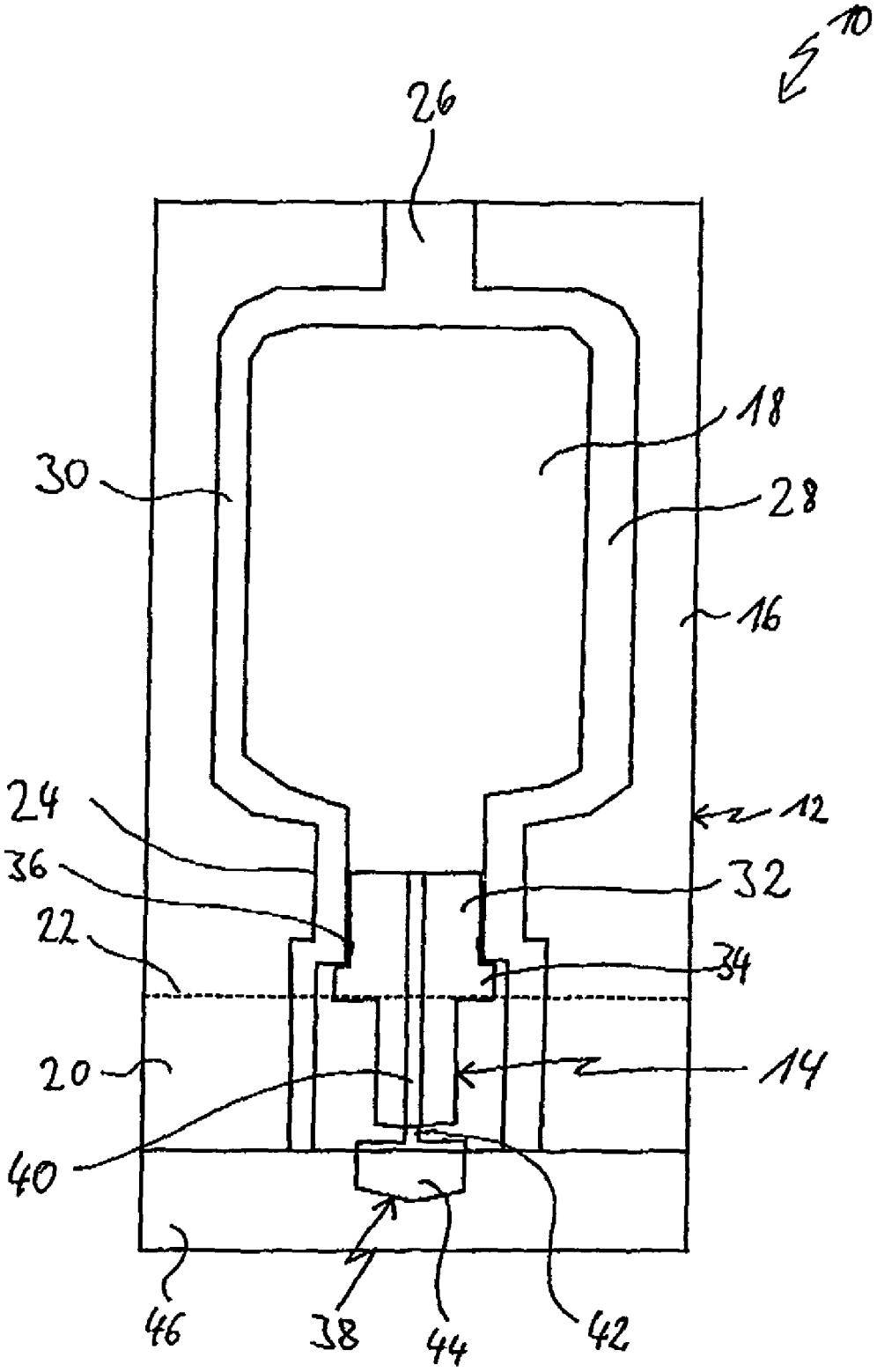
FIG. 1 is a schematic representation of the disposable dispensing device with an applicator configured according to the invention.

FIG. 1 represents a disposable dispensing device 10, which comprises a plastic enclosure 12, as well as, an applicator 14 that is housed in the plastic enclosure 12 and which, for example, is suitable for the application of nose drops or eye drops.

The plastic enclosure 12 is formed from two films that are sealed together and comprises an absorption section 16, in which a storage compartment 18 is configured. In the present case, the storage compartment 18 is thus used to store a liquid. Furthermore, the plastic enclosure 12 comprises a sealing section 20 that is configured as an integral part with the absorption section 16 and which is separated from it through a tear line and/or seam 22.

A multiplicity of plastics can be used as the material for the plastic enclosure of the disposable dispensing device according to the invention. Its manufacture, which uses a deep-drawing process, preferably employs thermoplastic polymers and particularly composite films of thermoplastic polymers with a barrier effect, such as films made of PE, PET, PVDC, COC, aluminum interlayers, and similar materials.

The absorption section 16 comprises a neck end 24, as well as, a filling end 26 facing away from the neck end, through which during the manufacture of the disposable dispensing device 10, the liquid is introduced into the storage compartment 18 and which is subsequently closed with a sealing tool. The plastic enclosure 12 has sealing seams 28 and 30 on the side, which extend along the absorption section 16 and the sealing section 20.

The illustrated plastic enclosure 12 is designed in the form of a small bottle and/or ampoule and is therefore convex.

However, the contours of the enclosure 12, its filling end 26 and its neck end 24 configuration can also vary in many ways from the design illustrated here.

The applicator 14 is configured in the form of a pipe section comprising an insert end 32 of increased diameter that fits into the neck end 24. In addition, the applicator 14 comprises a ring collar 34 that is supported for axial positioning on the plastic enclosure 12. In order to provide additional fixation, an annular groove 36 is configured on the applicator 14, into which the material of the plastic enclosure 12 engages.

The applicator 14 is provided with a sealing device 38 on the side facing away from the storage compartment 18, which is manufactured as an integral part with the applicator 14 and which serves to close an axial channel 40 of the applicator 14. For this purpose, the sealing device 38 is molded to the applicator 14 by means of a tapered separating section 42 representing a separation point.

The sealing device 38 comprises a tab-like, tapered end section 44, which represents an activating device and which is interlocked with the plastic enclosure 12. This interlocking is provided by means of a sealing seam 46 that runs in a transverse direction along the plastic enclosure 12.

In order to avoid the splashing of liquid when the disposable dispensing device is opened, the separating section 42 is spaced from the tear seam 22 in the direction away from the storage compartment 18.

During manufacture, a multitude of disposable dispensing devices can be arranged next to each other, in which the individual disposable dispensing devices can be separated from each other by means of perforated separation lines, resulting in a whole chain of disposable dispensing devices that are held together by the films. A user then simply tears off one unit at a time. There is also the possibility of punching out the disposable dispensing devices or punching out the plastic film sections between the disposable dispensing devices within the chain, leaving only the web as a connection.

Figure 2:
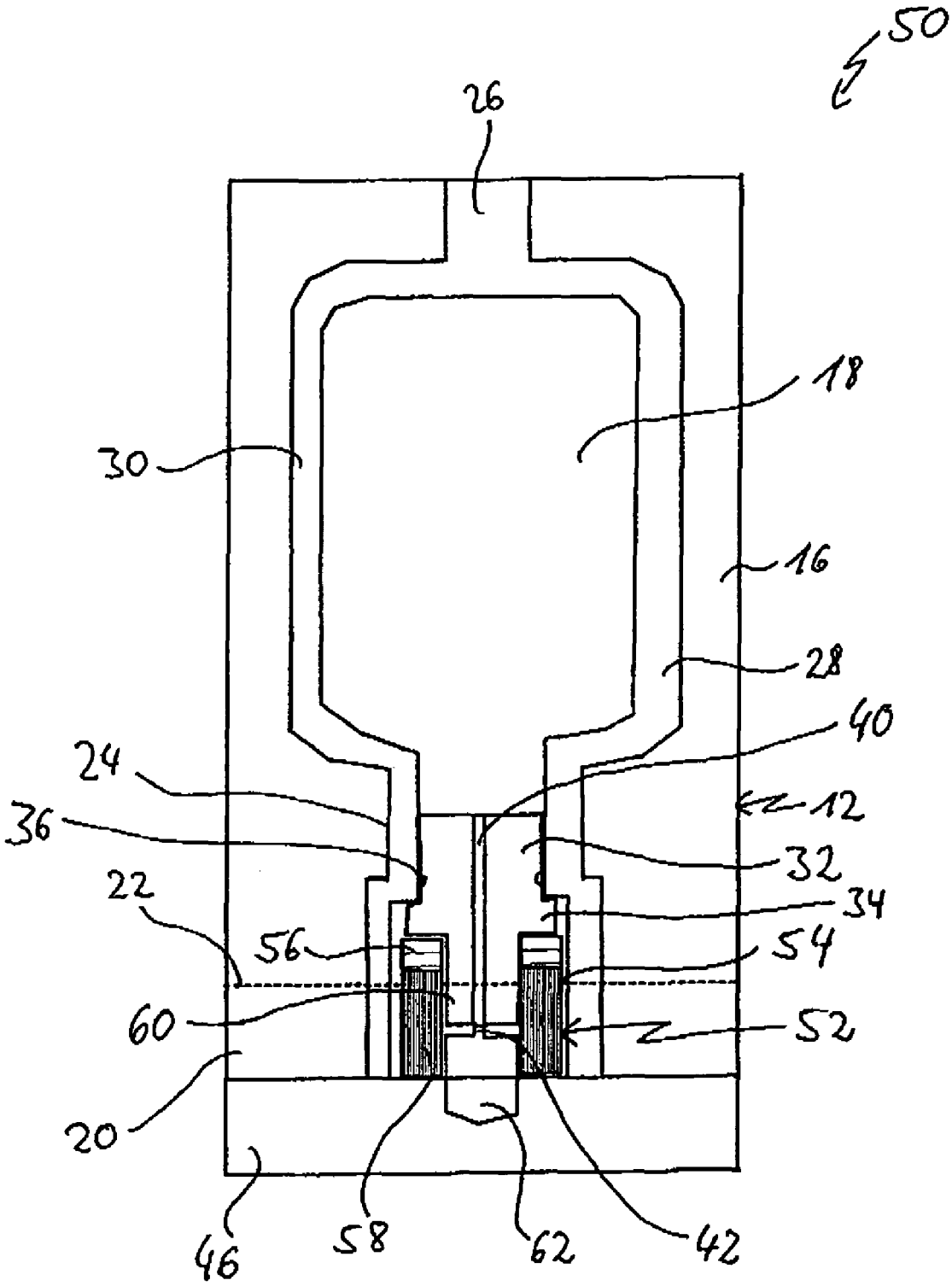
FIG. 2 is a schematic representation of the disposable dispensing device with an applicator configured according to the invention which is provided with a brush unit.

FIG. 2 represents a disposable dispensing device 50, which corresponds essentially to the disposable dispensing device in accordance with FIG. 1, except that it includes an applicator 52, which is provided with an application section 54 represented by a brush unit. The application section 54 is formed by an annular support 56 and a hair section 58 and is pushed onto a cylindrical section 60 of the applicator 52 facing away from the storage compartment 18.

Furthermore, the applicator 52 is provided with a sealing device 62 which is shaped in the form of a peg and which is molded to the applicator 52 through a separating section 42 in accordance with the design in FIG. 1, thereby closing the axial channel 40. The separating section 42 is arranged at the level of the hair section 58 of the brush unit 52 and is therefore radially surrounded by it. Alternatively, the hair section can also be directly attached to an integrally molded ring collar of the applicator 52. In other respects, the disposable dispensing device assembly 50 corresponds to that of the disposable dispensing device according to FIG. 1.

Figure 3:
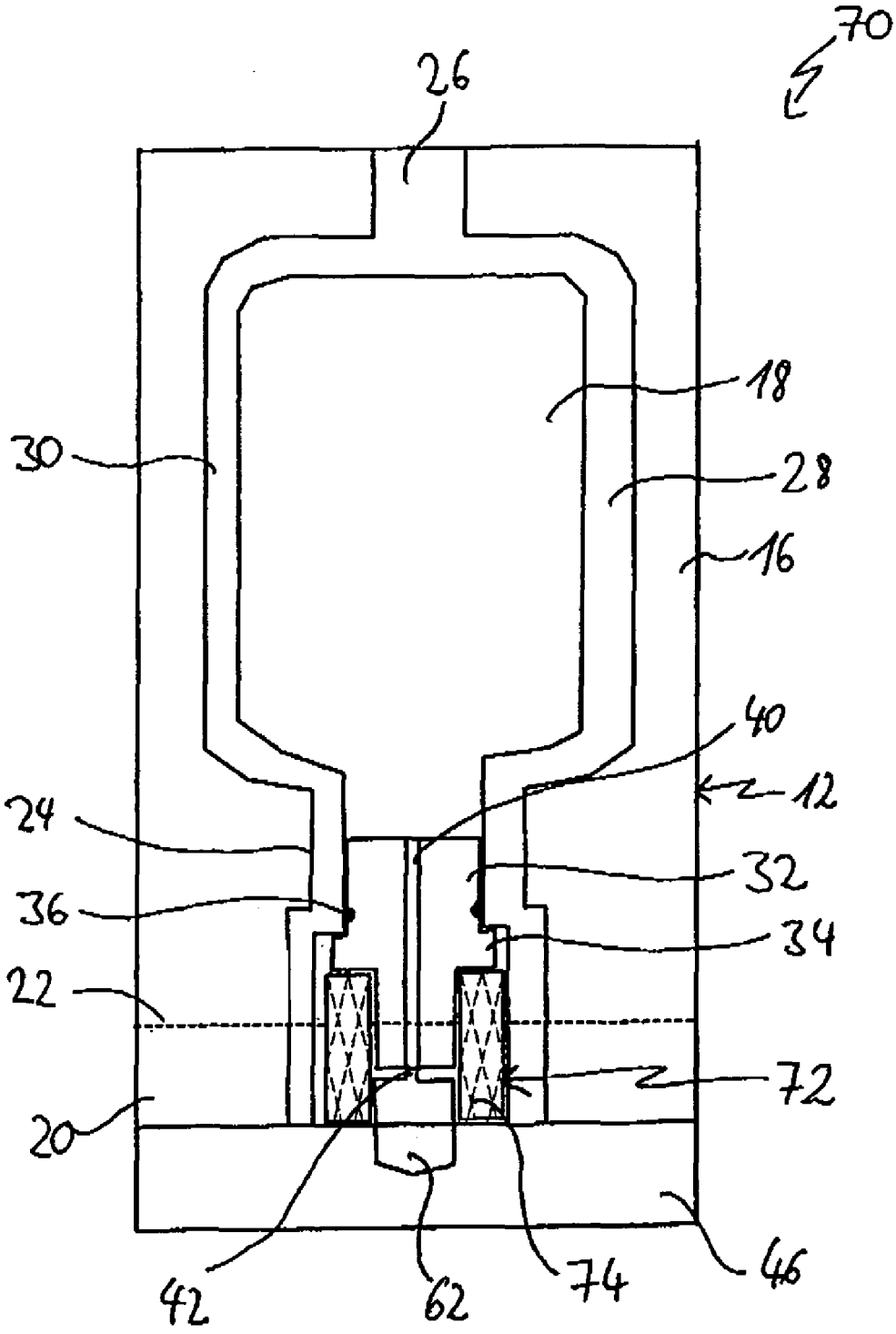
FIG. 3 is a schematic representation of the disposable dispensing device configured according to the invention, which is provided with a plastic foam unit.

FIG. 3 illustrates a disposable dispensing device 70 which essentially corresponds to the disposable dispensing device according to FIG. 2, however instead of an applicator 52, which has a brush unit representing an application section, it includes an applicator 72, which is provided with a application section 74, configured in the form of plastic foam unit.

During use, the sealing section 20 together with the sealing device 62 are separated from the absorption section 16 and/or the applicator 72. By pressing on the absorption section 16, the liquid material contained in storage compartment 18 is then delivered through the axial channel 40 of the applicator, so that the plastic foam unit 74 is impregnated with the material, which can then be applied. In the embodiment according to FIG. 2, this method is used to impregnate the hair section 58.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

The invention claimed is:

1. A disposable dispensing device for liquid, paste, and flowable free-flowing materials, said device comprising:

a first film;

a second film sealed to said first film and forming a fillable and sealable first enclosure therebetween with an absorption section and a sealing section, said absorption section including a compartment for storing the material and said sealing section separated from the absorption section by a tear seam;

an applicator fixed in the enclosure between said first film and said second film and extending across said tear seam into said absorption section;

a filling end of said absorption section facing away from said applicator for filling the compartment with the material;

a channel formed through said applicator and connected with the absorption section for discharging the material from the compartment; and a sealing device, which closes the channel and which is molded to the applicator by means of a separating section and which is enclosed by the sealing section of the enclosure between the first film and the second film and which, in order to dispense the material through the channel of the applicator, the sealing device is detached from the applicator by separating the absorption section from the sealing section along said tear seam, wherein the separating section is spaced from the tear seam in order to avoid splashing of fluid when the separating section is detached from the applicator, said separating section defining a separation point of said sealing device from said applicator.

2. The disposable dispensing device according to claim 1, in which the sealing device comprises an activating device in the form of a tapered or a peg-shaped end of the sealing device.

3. A disposable dispensing device for liquid, paste, and flowable free-flowing materials, said device comprising:

a first film;

a second film sealed to said first film and forming a fillable and sealable first enclosure therebetween with an absorption section and a sealing section, said absorption section including a compartment for storing the material and said sealing section separated from the absorption section by a tear seam;

an applicator fixed in the enclosure between said first film and said second film and extending across said tear seam into said absorption section;

a filling end of said absorption section facing away from said applicator for filling the compartment with the material;

a channel formed through said applicator and connected with the absorption section for discharging the material from the compartment; and a sealing device, which closes the channel and which is molded to the applicator by means of a separating section and which is enclosed by the sealing section of the enclosure between the first film and the second film and which, in order to dispense the material through the channel of the applicator, the sealing device is detached from the applicator by separating the absorption section from the sealing section along said tear seam, said sealing device including an activating device interlocked with the sealing section, such that said activating device separates from said applicator upon separation of said sealing section from said absorption section along said tear seam to open said channel.

4. The disposable dispensing device according to claim 1, in which the applicator is configured essentially in the shape of a pin.

5. The disposable dispensing device according to claim 1, in which the applicator comprises an application tip, which fits into an inside neck end facing away from the storage compartment of the enclosure and comprises a groove, into which the enclosure engages.

6. The disposable dispensing device according to claim 1, in which the applicator comprises a ring collar that is supported on the enclosure for axial positioning.

7. The disposable dispensing device according to claim 1, in which the applicator is a discharging device that resembles a pipe section.

8. The disposable dispensing device according to claim 1, in which the applicator comprises a diffuser or a nozzle.

9. The disposable dispensing device according to claim 1, in which the applicator is provided with an application section.

10. The disposable dispensing advice according to claim 9, in which the application section comprises a brush unit.

11. The disposable dispensing device according to claim 9, in which the application section comprises a plastic foam unit.

12. A disposable dispensing device comprising:

a first film;

a second film sealed to said first film and forming a first enclosure defining therebetween an absorption section and a sealing section, said absorption section including a storage compartment for storing a flowable material;

a tear seam formed in said first film and said second film separating said absorption section from said sealing section;

an applicator disposed between said first film and said second film and extending into said absorption section, said applicator being fixed in said absorption section and including a channel in fluid communication with said absorption section extending across said tear seam; and a sealing device closing said channel, molded to the applicator, and sealed between said first film and said second film in said sealing section, wherein separation of said sealing section from said absorption section along said tear seam removes said sealing device to open said channel, in which the sealing device comprises an activating device in the form of a tapered or a peg-shaped end of the sealing device sealed between said first film and said second film in said sealing section, wherein said activating device separates from said applicator upon separation of said sealing section from said absorption section along said tear seam to open said channel.

13. The disposable dispensing advice according to claim 12, in which the enclosure is manufactured from the first and second films by a method used for standard packaging of suppositories, which, after sealing around the edges, are shaped into enclosures through vacuum forming or alternatively by means of highly pressurized gas.

14. The disposable dispensing device according to claim 1, in which the enclosure in the area of the storage compartment for discharging the material is elastically deformed by compression.

15. The disposable dispensing device according to claim 1, in which the absorption section comprises lateral sealing seams and a neck end and that the tear seam extends essentially transversely with respect to the lateral sealing seams.

16. The disposable dispensing device according to claim 1, in which the storage compartment contains a first material component and the applicator contains a second material component.

17. The disposable dispensing device according to claim 12, in which said absorption section includes a filling end for filling the compartment with the material.

18. The disposable dispensing device according to claim 17, in which said filling end faces away from said applicator for filling the compartment with the material.

19. The disposable dispensing device according to claim 12, in which said sealing section closes said channel with a separating section spaced from the tear seam in order to avoid splashing of fluid when the separating section is detached from the applicator, said separating section defining a separation point of said sealing device from said applicator.

20. The disposable dispensing device according to claim 12 in which said first film and said second film form a second enclosure adjacent said first enclosure.

21. The disposable dispensing device according to claim 20, in which said first enclosure and said second enclosure are separated by a separation line.

22. The disposable dispensing device according to claim 1 in which said first film and said second film form a second enclosure adjacent said first enclosure.

23. The disposable dispensing device according to claim 22, in which said first enclosure and said second enclosure are separated by a separation line.

24. The disposable dispensing device according to claim 3, in which the activating device is in the form of a tapered or a peg-shaped end of the sealing device.

* * * * *